US005950335A

United States Patent [19]

Okajima

[11] Patent Number: 5,950,335

[45] **Date of Patent: *Sep. 14, 1999**

[54] SNOWBOARD BOOTS

[75] Inventor: Shinpei Okajima, Izumi, Japan

[73] Assignee: Shimano, Inc., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/677,028

[22] Filed: Jul. 8, 1996

[30] Foreign Application Priority Data

Jul. 12, 1995 [JP] Japan ..... 7-199071

[51] Int. Cl.[6] ..... A43B 5/04; A43B 7/22

[52] U.S. Cl. ..... 36/115; 36/50.5; 36/89; 36/91; 36/55

[58] Field of Search ..... 36/50.1, 50.5, 36/88, 89, 91, 92, 114, 115, 116, 55, 10, 71, 117.6, 117.9, 118.1

[56] References Cited

U.S. PATENT DOCUMENTS

| | | | |
|---|---|---|---|
| 1,258,629 | 3/1918 | Bliss | 36/170 |
| 1,286,787 | 12/1918 | Rokahr | 36/91 |
| 2,531,763 | 11/1950 | Andre | 36/89 |
| 3,323,232 | 6/1967 | Danowsky | 36/170 |
| 3,377,721 | 4/1968 | Johnson | 36/89 |
| 3,530,596 | 9/1970 | Kaufmann et al. | 36/99 |
| 3,566,486 | 3/1971 | Conway | 36/71 |
| 4,676,011 | 6/1987 | O'Rourke et al. | 36/89 |
| 4,860,464 | 8/1989 | Misevich et al. | 36/114 |
| 4,924,605 | 5/1990 | Spademan | 36/88 |
| 5,105,565 | 4/1992 | Barret | 36/88 |
| 5,154,011 | 10/1992 | Holzl et al. | 36/89 |
| 5,566,475 | 10/1996 | Donnadieu | 36/170 |
| 5,692,320 | 12/1997 | Nichols | 36/170 |

FOREIGN PATENT DOCUMENTS

| | | | |
|---|---|---|---|
| 804900 | 5/1951 | Germany | 36/117.1 |
| 575969 | 4/1958 | Italy | 36/117.1 |

*Primary Examiner*—M. D. Patterson
*Attorney, Agent, or Firm*—James A. Deland

[57] ABSTRACT

A snowboard boot includes a sole region, an upper outer layer extending from the sole region to an instep region, and a foot support disposed inside the upper outer layer. The foot support includes a right foot support and a left foot support. The right foot support is disposed inside the upper outer layer of the boot on a right side thereof and extends from the sole region toward the instep region. The right foot support includes a right foot tightening structure disposed in close proximity to the instep region. The left foot support is disposed inside the upper outer layer of the boot on a left side thereof and extends from the sole region toward the instep region. The left foot support includes a left foot tightening structure disposed in close proximity to the instep region. If desired, an insulating layer may be disposed between the upper outer layer and the right and left foot supports. The outer layer may include its own foot tightening structure for tightening the upper outer layer independently of the foot support.

10 Claims, 2 Drawing Sheets

SNOWBOARD BOOTS

BACKGROUND OF THE INVENTION

The present invention is directed to snowboard boots and, more particularly, to a snowboard boot which includes a more effective tightening mechanism for tightening the boot the foot.

Snowboards, used as modem sports equipment, are a modification of skis. Typical snowboards are simple short boards which accommodate two feet, but they require greater leg strength to operate than skis. As a result, snowboard boots must be fixed more strongly to the snowboard than ski boots are fixed to skis, and the snowboard boots must also be fixed more strongly to the feet.

Typical snowboard boots typically include heat insulators such as thick sponges disposed between the foot and the outermost portion of the boot main body. When the leather that constitutes the outermost portion (shell) of the boot main body is fastened with a cord, buckle, Velcro® Fastener or the like, it is difficult to hold the foot securely in the boot main body due to the fact that the heat insulators can not be fixed and are readily deformed. On the other hand, secure tightening, even when it is achieved, sometimes impedes blood circulation in the feet. Because this must be prevented, the boot cannot be tightened with considerable force through the use of buckles and other conventional structures.

SUMMARY OF THE INVENTION

The present invention is directed to a snowboard boot which includes a more effective tightening mechanism for tightening the boot to the foot. In particular, a tightening means is located inside the boot, and, if desired, the outer layer of the boot may be tightened independently of the inner tightening means.

In one embodiment of the present invention, a snowboard boot includes a sole region, an upper outer layer extending from the sole region to an instep region, and a foot support disposed inside the upper outer layer. The foot support includes a right foot support and a left foot support. The right foot support is disposed inside the upper outer layer of the boot on a right side thereof and extends from the sole region toward the instep region. The right foot support includes a right foot tightening structure disposed in close proximity to the instep region. The left foot support is disposed inside the upper outer layer of the boot on a left side thereof and extends from the sole region toward the instep region. The left foot support includes a left foot tightening structure disposed in close proximity to the instep region. If desired, an insulating layer may be disposed between the upper outer layer and the right right and left foot supports. The outer layer may include its own foot tightening structure for tightening the upper outer layer independently of the foot support.

In a more specific embodiment the right foot support comprises a plurality of spaced apart right foot support components extending toward the instep region and forming a comb-shaped structure, and the left foot support comprises a similar plurality of spaced apart left foot support components extending toward the instep region and forming a comb structure. Each of the plurality of right and left foot support components includes an eyelet formed at a free end thereof so that a tightening cord may be threaded through the eyelets to tighten the foot support to the foot.

In an even more specific embodiment, the boot includes a leg outer layer extending upwardly from the upper outer layer and extending from a back leg region to the instep region. A leg support is disposed inside the leg outer layer, wherein the leg support includes a right leg support and a left leg support. The right leg support is disposed inside the leg outer layer of the boot on a right side thereof and extends from the back leg region toward the instep region. The right leg support includes a plurality of right leg support components forming a comb shape and terminating at the instep region. Similarly, the left leg support is disposed inside the leg outer layer of the boot on a left side thereof and extends from the back leg region toward the instep region. The left leg support also includes a plurality of left leg support components forming a comb shape and terminating at the instep region. Each of the plurality of right and leg support components includes an eyelet formed at a free end thereof so that a tightening cord may be threaded through the eyelets to tighten the leg support to the leg.

DETAILED DESCRIPTION OF THE EMBODIMENTS

Figure 1:
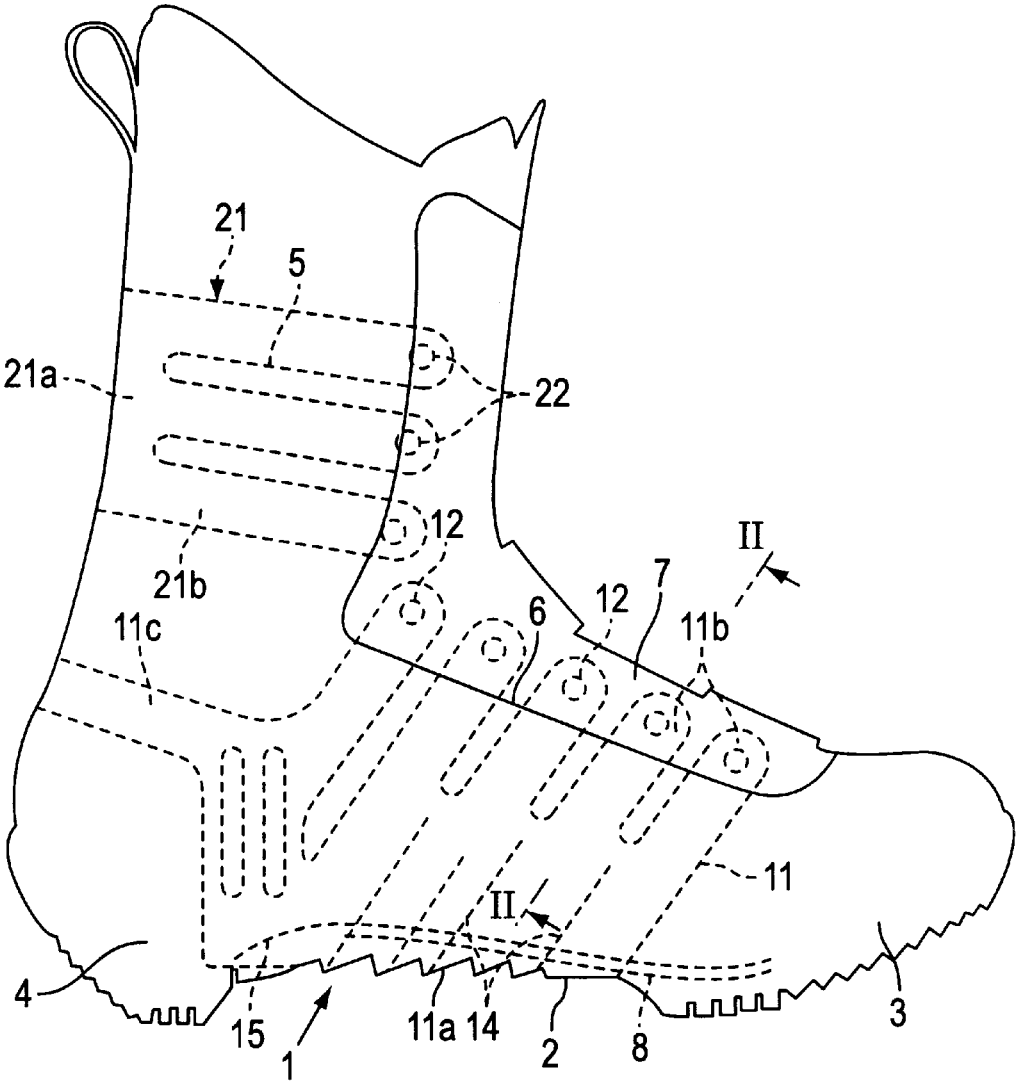
FIG. 1 is a side view of a particular embodiment of a snowboard boot according to the present invention.

FIG. 1 is a side view of a particular embodiment of a snowboard boot according to the present invention. As shown in FIG. 1, the snowboard boot main body 1 basically comprises a sole 2, a toe 3, a heel 4, a cylindrical leg 5, and an instep 6 extending from the leg 5 to the toe 3. An instep-reinforcing member 7, which is made of leather (man-made or natural), shaped as a saddle, and designed to reinforce and tighten the instep 6, is attached to the instep 6 by sewing, bonding, or another means. An insole 8 that is in conformity with the curved surface of the sole 2 is provided to the sole 2. The insole 8 is made from a plastic, metal, or other relatively rigid material to ensure foot stability.

A foot support 11 is mounted inside the main body 1. In this embodiment, the foot support 11 is formed from a relatively hard resin or from a pliable, unstretchable material such as a flexible resin. In FIG. 1, the foot support 11 is shown in an open state after being superposed on the snowboard boot main body 1. Thereafter the foot support 11 is mounted on the snowboard boot main body 1 in conformity with the curved surfaces on the inside of the toe 3, heel 4, and instep 6.

In this embodiment, the foot support 11 comprises a lower component 11*a*, a plurality of upper components 11*b*, and a back component 11*c*. The holding edge (lasting margin) of the lower component 11*a* of the foot support 11 is folded back and securely integrated with the insole 8. The integration can be achieved by sewing, tucking, bonding, insertion, or any other known means. A plurality of cuts or slits 14 formed in the lower component 11*a* extend forward and upward at a slant with respect to the sole 2. Upper components 11*b* are directed forward and upward at a slant with respect to the sole 2 away from the lower component 11*a*, and they are elongated to form a comb shape. First cord-threading holes 12 shaped as eyelets are bored in the corresponding tips of the upper components 11*b*.

The foot support 11 is provided on the left and right sides of the boot. In this embodiment, the left and right halves of the foot support 11 are joined together by a back component 11*c* which is shaped like a strap and which passes around the back of the boot near the heel 4, but such a connection is not necessary.

A leg support 21 having the same shape as the foot support 11 is mounted inside the leg 5. The leg support 21 comprises a back component 21*a* folded around the back of the leg, and front components 21*b* projecting forward from the both sides of the back component 21*a*. A plurality of elongated front components 21*b* are provided, and these components extend forward from the back component 21*a*, forming a comb shape. Second cord-threading holes 22 in the form of eyelets are bored in the corresponding tips of the elongated front components 21*b*.

Figure 2:
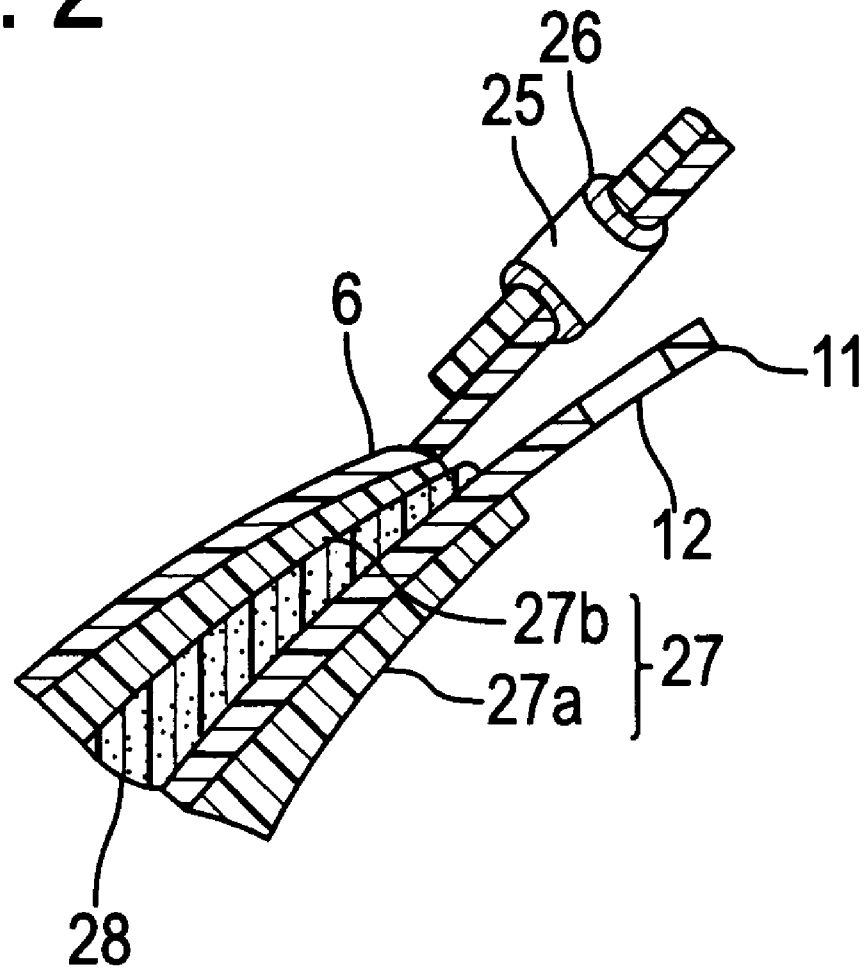
FIG. 2 is a cross sectional view taken along line II—II in FIG. 1.

FIG. 2 is a cross section taken along line II—II in FIG. 1. A second eyelet 26 forms a second cord-threading hole 25 in the instep 6. The foot support 11 is lined on both sides with a conforming liner 27. The liner 27 comprises an inner liner 27*a* (such as EVA; ethylene-vinyl acetate copolymer resin) and an outer liner 27*b* (preferably made of the same material as 27*a*, that is, ethylene-vinyl acetate copolymer resin, or EVA). The outer liner 27*b* is sandwiched between the instep 6 and the foot support 11. The inner liner 27*a* is disposed inside the foot support 11. A spongy heat insulator 28 (for example, expanded polyurethane) is interposed between the foot support 11 and the inner liner 27*a*.

To use the boot according to the present invention, a lace (not shown) is threaded through the plurality of the first cord-threading holes 12 of the upper components 11*b*. By pulling at the both ends of the lace thus threaded, it is possible to draw closer together the upper components 11*b* on both sides of the foot support 11. The upper components 11*b* acted on with this tightening force tightly secure the foot without the intermediary of the heat insulator 28. If desired, the lace can also be threaded through a second eyelet 25 of the instep 6 of the snowboard boot main body 1.

The tightening force is exerted directly on the foot, so the foot is stably held against the strong insole 8 of the sole. Such tightening holds the heel steady against the back component 11*c* as well. The instep 6 and the instep-reinforcing member 7 also may be tightened on the outside with a lace in a conventional manner. If desired, separate laces can be used for the lace that is threaded through the first cord-threading holes 12 and for the lace that is threaded through the second eyelets 25. In this case the tension levels of the two cords are independent of each other. The main body and the foot support 11 can still be tightened independently when a single cord doubles for both uses.

While the above is a description of various embodiments of the present invention, further modifications may be employed without departing from the spirit and scope of the present invention. For example, the foot support 11 described above was positioned inside the boot main body 1 close to the foot inside the heat insulator 28, but the foot support 11 can also be placed outside the outer structure 1, although this reduces the foot tightening effect somewhat. In addition, although the first and second cord-threading holes 12 and 22 in this embodiment were shaped as eyelets, it is also possible to use a common structure such as that in which circular metal rings are enclosed in plate-shape metal components or the like, and these metal plate components are fastened to form eyelets.

Thus, the scope of the invention should not be limited by the specific structures disclosed. Instead, the true scope of the invention should be determined by the following claims.

What is claimed is:

1. A snowboard boot comprising:

a sole;

an upper outer layer fixed to the sole and extending from the sole to an instep region;

a foot support including:

a right foot support disposed inside the upper outer layer of the boot and fixed to the sole on a right side thereof, the right foot support extending from the sole toward the instep region, the right foot support including a right side wall and a plurality of right foot: support components formed as one piece with and extending upwardly from the right side wall and extending parallel to each other, wherein the plurality of right foot support a left foot support disposed inside the upper outer layer of the boot and fixed to the sole on a left side thereof, the left foot support extending from the sole toward the instep region, the left foot support including a left side wall and a plurality of left foot support components formed as one piece with and extending upwardly from the left side wall and extending parallel to each other, wherein the plurality of left foot support components form a comb shape and each left foot support component terminates with a free upper end at the instep region;

wherein each of the plurality of right foot support components and each of the plurality of left foot support components defines only one eyelet formed as one piece at the free upper end thereof; and wherein the plurality of right foot support components and the plurality of left foot support components extend toward each other in a nonoverlapping manner;

a right insulating layer disposed between the upper outer layer and the right foot support; and a left insulating layer disposed between the upper outer layer and the left foot support.

2. The snowboard boot according to claim 1 wherein the outer layer includes an upper outer layer foot tightening structure for tightening the upper outer layer independently of the foot support.

3. The snowboard boot according to claim 2 wherein the upper outer layer foot tightening structure comprises a plurality of eyelets disposed in the upper outer layer at the instep region.

4. The snowboard boot according to claim 1 wherein the foot support further comprises a back foot support bridging the right foot support and the left foot support around a back side of the boot, wherein the back foot support is formed as one piece with the right foot support and the left foot support.

5. The snowboard boot according to claim 1 wherein the snowboard boot further comprises a leg outer layer extending upwardly from the upper outer layer and extending from a back leg region to the instep region, and further comprising a leg support including:

a right leg support disposed inside the leg outer layer of the boot on a right side thereof and extending from the back leg region toward the instep region, the right leg support including a plurality of right leg support components forming a comb shape and terminating at the instep region; and a left leg support disposed inside the leg outer layer of the boot on a left side thereof and extending from the back leg region toward the instep region, the left leg support including a plurality of left leg support components forming a comb shape and terminating at the instep region; and wherein each of the plurality of right leg support components and each of the plurality of left leg support components includes an eyelet formed at a free end thereof.

6. The snowboard boot according to claim 5 wherein the leg support further comprises a back leg support bridging the right leg support and the left leg support around a back side of the boot.

7. The snowboard boot according to claim 1 wherein each of the plurality of right foot support components and each of the plurality of left foot support components extends forward and upward at a slant with respect to the sole.

8. The snowboard boot according to claim 1 wherein the foot support is formed from a hard resin.

9. The snowboard boot according to claim 1 wherein the foot support is formed from an unstretchable material.

10. The snowboard boot according to claim 9 wherein the foot support is formed from a flexible resin.

* * * * *

UNITED STATES PATENT AND TRADEMARK OFFICE

CERTIFICATE OF CORRECTION

PATENT NO. : 5,950,335
DATED : September 14, 1999
INVENTOR(S) : Shinpei Okajima

It is certified that error appears in the above-identified patent and that said Letters Patent is hereby corrected as shown below:

Column 4,
Line 10, after "right foot support" the following text should be added:
-- components form a comb shape and each right foot support component terminates with a free upper end at the instep region; and --

Signed and Sealed this

Seventh Day of August, 2001

*Attest:*

Nicholas P. Godici

*Attesting Officer*

NICHOLAS P. GODICI
*Acting Director of the United States Patent and Trademark Office*